US006715262B2

(12) United States Patent
Malin et al.

(10) Patent No.: US 6,715,262 B2
(45) Date of Patent: Apr. 6, 2004

(54) FORM, FILL AND SEAL METHOD AND APPARATUS FOR FORMING RECLOSABLE BAGS

(75) Inventors: Art Malin, Northbrook, IL (US); Stanley Piotrowski, Schiller Park, IL (US); Michael McMahon, Palatine, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/844,617

(22) Filed: Apr. 27, 2001

(65) Prior Publication Data

US 2002/0157351 A1 Oct. 31, 2002

(51) Int. Cl.[7] ..... B65B 61/18; B65B 9/06

(52) U.S. Cl. ..... 53/412; 53/451; 53/133.4; 53/139.2; 53/551

(58) Field of Search ..... 53/412, 451, 133.4, 53/139.2, 551

(56) References Cited

U.S. PATENT DOCUMENTS 5,425,216 A * 6/1995 Ausnit ..... 53/412
5,638,586 A * 6/1997 Malin et al. ..... 383/63
5,956,924 A 9/1999 Thieman
6,047,521 A 4/2000 Terminella et al.

FOREIGN PATENT DOCUMENTS

EP 0 978 450 A1 2/2000
EP 1 053 948 A2 11/2000
GB 2278803 A * 12/1994 ..... B29C/65/18

* cited by examiner

*Primary Examiner*—Stephen F. Gerrity
(74) *Attorney, Agent, or Firm*—Pitney, Hardin, Kipp & Szuch LLP

(57) ABSTRACT

A method is disclosed for forming reclosable packages at a form, fill and seal (FFS) apparatus by advancing a film of package making material longitudinally to form a tube while guiding opposite longitudinal edges of the film into a fin. A zipper having interlocking members and an attached flange is fed into the fin by capturing external surfaces of the interlocking members within a first guide member positioned adjacent to said fin and feeding the flanges along opposite sides of a second guide member positioned within said fin. An apparatus for performing the method is also disclosed.

11 Claims, 3 Drawing Sheets

FORM, FILL AND SEAL METHOD AND APPARATUS FOR FORMING RECLOSABLE BAGS

BACKGROUND OF THE INVENTION

The present invention relates to reclosable plastic bags and in particular to a method and for forming, filling and sealing such bags.

In U.S. Pat. No. 4,709,533 there is disclosed a method and apparatus for forming, filling and sealing reclosable plastic wherein the edges of a film of bag material are brought together into a fin at a form, fill and seal (FFS) machine and a zipper is fed into and sealed to the fin. While the disclosed method of this patent works fine for the manufacture of relatively simple reclosable packages, problems are countered in the production of more sophisticated packages such as where a slider is to be attached to the zipper or where a hermetic seal is required or desired to protect the package contents.

SUMMARY OF THE INVENTION

In view of the above, it is the principal object of the present invention to provide an improved method for the manufacture of reclosable packages on a form fill and seal machine which enables the placement of sliders on the zipper during the package manufacturing process. A further object is to provide such a method that also permits the formation of a peel seal below the zipper during the package formation process.

Still another object is to provide such a method that can be practiced on conventional FFS equipment with modifications that may readily be made.

Still a further object is to provide the equipment for practicing the desired method. The above and other beneficial objects and advantages are attained in accordance with the present invention by advancing a film of package making material longitudinally to form a tube while guiding opposite longitudinal edges of the film into a fin. A zipper having interlocking members and an attached flange is fed into the fin by capturing external surfaces of the interlocking members within a first guide member positioned adjacent to said fin and feeding the flanges along opposite sides of a second guide member positioned within said fin. The flanges are attached to respective sides of the fin by sealing against the second guide. One of the flanges extends beyond the other flange. The flange extension is attached to the side of the fin adjacent to the other flange with a peel seal. The interlocking members are stomped together at bag length intervals and a slider is attached to the interlocking members between each pair of adjacent stomps.

DETAILED DESCRIPTION OF THE PREFERRED EMBODIMENTS

Figure 1:
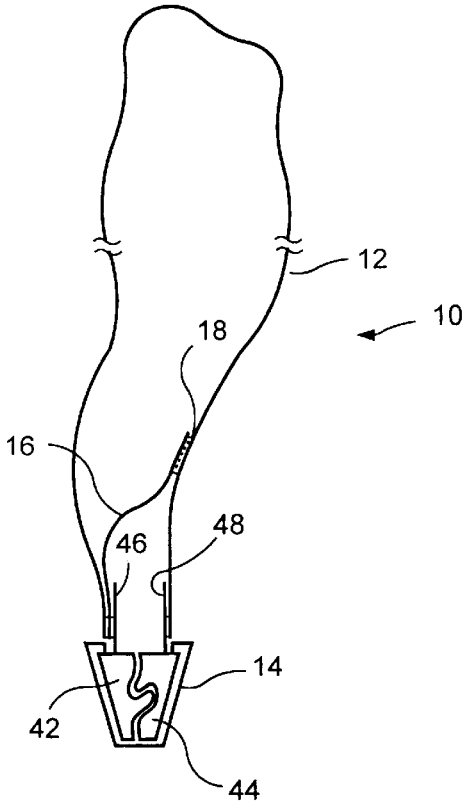
FIG. 1 is a schematic sectional view of a reclosable package made in accordance with the present invention.

Reference is now made to the drawings and to FIG. 1 in particular wherein a reclosable bag 10 manufactured in accordance with the present invention is depicted. The bag 10 includes a main body portion 12 and has a zipper that may be opened and closed by a slider 14. The contents of the bag 10 are protected by a flange 16 that is joined to the package wall by a peel seal 18. The initial opening of the bag requires that the peel seal be ruptured, thereby evidencing that the bag has been opened.

Figure 2:
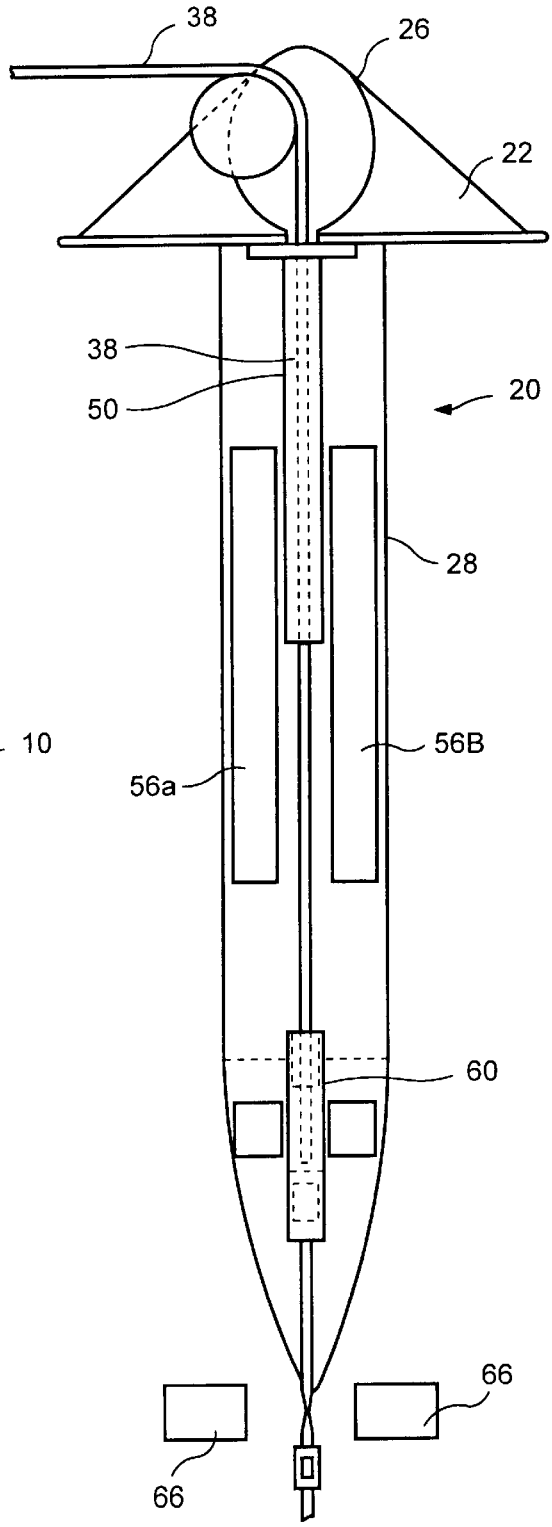
FIG. 2 is a front elevational schematic view of a FFS machine for practicing the present invention.
Figure 3:
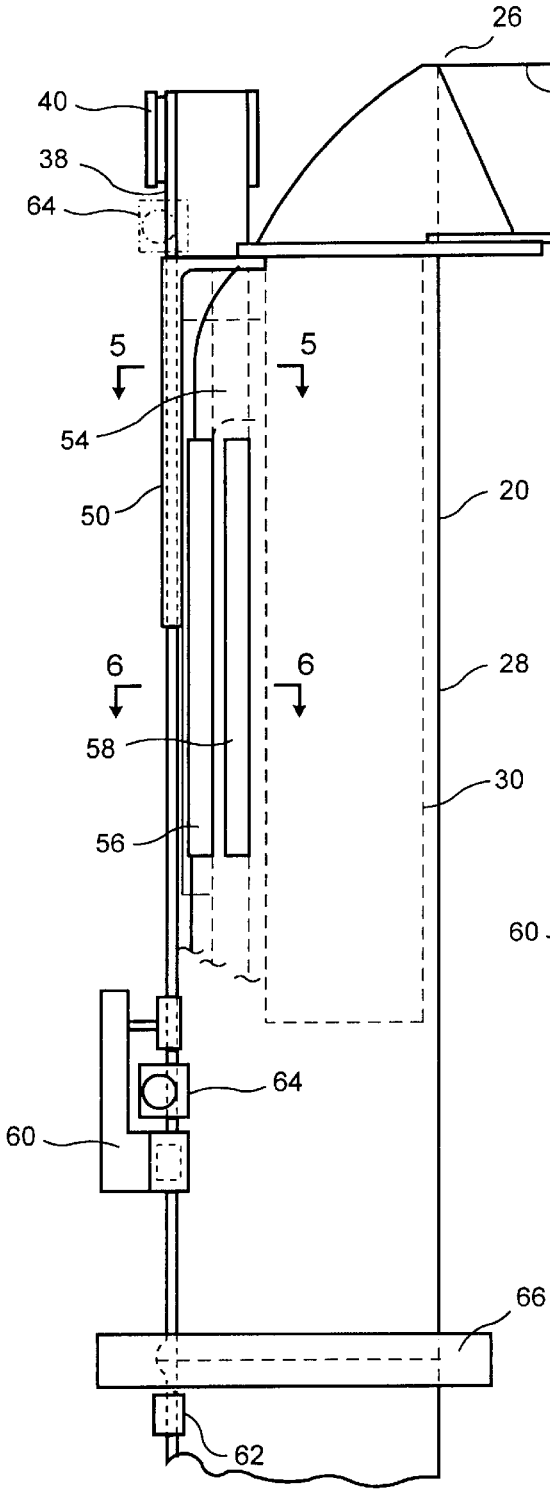
FIG. 3 is a side elevational schematic view of the FFS machine of FIG. 2.

The bag 10 is formed on a vertical FFS machine 20 depicted in FIGS. 2 and 3. A bag film 22 is played off a spool 24 and over a forming collar 26 which transforms the flat, horizontally moving film into a vertical tube 28 about the fill tube 30 of the FFS machine. The longitudinal edges 32, 34 of the tube 28 are brought together into a fin 36. A zipper 38 is played off zipper spool 40 and fed into the fin 36. The zipper 38 includes a first profile 42 and a second profile 44. Each of the profiles has an interlocking member engageable with the other profile and an attached flange 46, 48, with one flange 46 being longer than the other flange 48. The flanges 46, 48 are preferably formed of webs integral with the profiles to which are bonded extensions. The extensions are formed of universally compatible material thereby enabling the profiles to be used with a wide range of bag making films.

Figure 5:
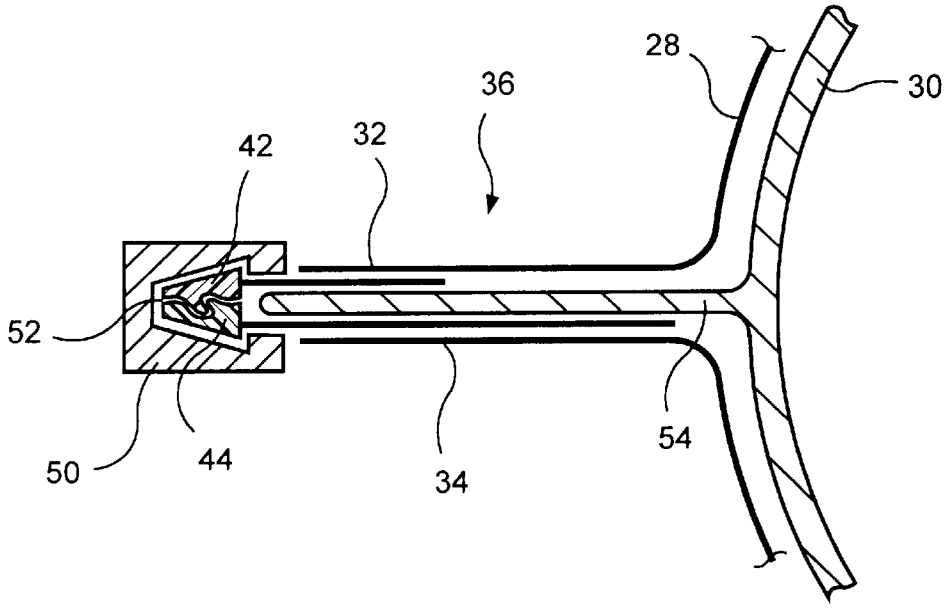
FIG. 5 is a sectional view taken off line 5—5 of FIG. 3 in the direction indicated by the arrows; and, FIG. 6 is a sectional view taken off line 6—6 of FIG. 3 in the direction indicated by the arrows.
Figure 6:
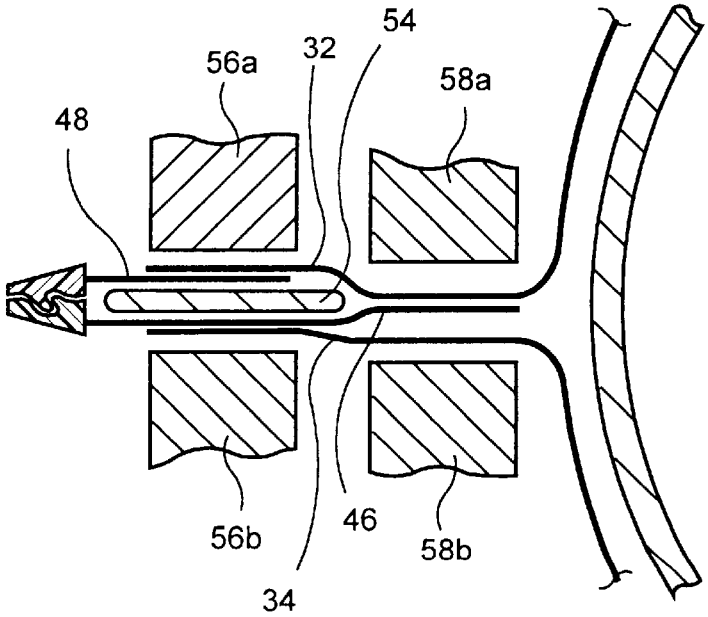

In order to properly align the zipper relative to the bag film, the zipper 38 is fed into a first guide 50 that extends longitudinally parallel to the fill tube 30 of the FFS machine. The guide 50 extends from the top of the fill tube for a substantial portion of the length of the fill tube. As seen in FIG. 5, the guide 50 includes a groove 52 in which the external surfaces of the mated interlocked members of the profiles 42, 44 ride, thereby capturing the profiles and fixing the flanges of zipper 38 within the fin 36.

A second guide 54 extends radially outwardly from the fill tube in line with the fin 36. The guide 54 extends downwardly from the top of the fill tube to coextend with two pairs of longitudinal seal bars, 56 and 58. The radially outward seal bars 56*a* and 56*b* are lined up with and substantially as wide as the short flange 48. The guide 54 is positioned to extend between the flanges 46 and 48 so that the seal bars 56*a* and 56*b* can be closed against the guide 54. The short flange 48 and the adjacent Fin 32 are captured between seal bar 56*a* and one side of guide 54. The outermost portion of the wider flange 46 (i.e. closest to the profiles) is captured between the seal bar 56*b* and the other side of guide 54. As a result, when seal bars 56*a* and 56*b* are closed with heat and pressure, the flanges 46 and 48 are respectively sealed to the inner surfaces of fins 34 and 32.

The inner seal bars 58 move toward one another in a cut-out formed in guide 54 so that they directly capture the fin and the innermost portion of the wider flange 46 (i.e. furthest from the profiles) between them. Seal bar 58*a* is heated while seal bar 58*b* is not. As a result, when the seal bars close, flange 46 is loosely tacked to the inner surface of fin 32. In this connection, to control the bond, a peel seal material may be applied to the surface of flange 46 to be bonded to fin 32.

Figure 4:
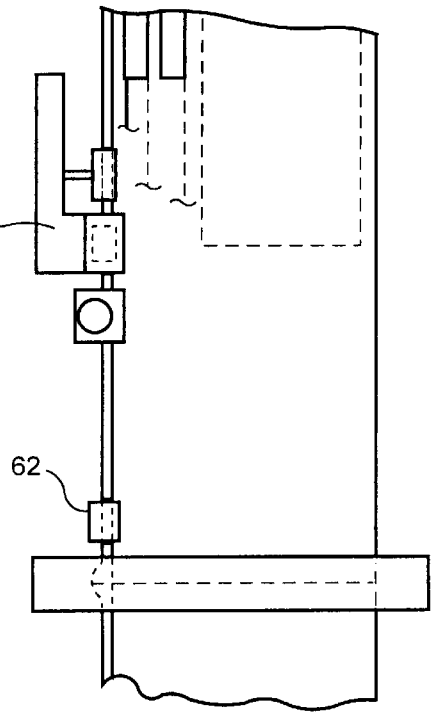
FIG. 4 is a fragmentary elevational schematic view similar to FIG. 3 but modified to show an alternative placement of the zipper stomper and slider inserter.

A slider insertion mechanism 60 is provided below the seal bars 56, 58 to apply a slider 62 to the interlocking members of the profiles. To retain the slider 62 on the zipper, the zipper is crushed or stomped by a stomper mechanism 64 which serves to deform the interlocking members sufficiently to prevent the slider from be pulled off the interlocking members. The stomper 64 may be positioned upstream of the slider applicator 60 as depicted in FIG. 3, or downstream of the slider applicator as shown in FIG. 4. or upstream of the zipper guide as shown in phantom in FIG. 3.

After the slider is applied to the zipper, a cross seal is formed transversely across the film tube through the stomped zipper by seal bars 66 and the contents of the package are filled against the seal. The process is then repeated with the next transverse seal being formed through the next stomped portion of the zipper, thereby forming the opposite side seal of the first package and releasing the thus completed and filled package from the tube while simultaneously forming the first side seal for the next package.

Thus, in accordance with the above, the aforementioned objectives are effectively attained.

Having thus described the invention, what is claimed is:

1. A method of forming reclosable packages at a form, fill and seal (FFS) apparatus comprising the steps of:

advancing a film of package making material longitudinally to form a tube while guiding opposite longitudinal edges of said film into a fin;

feeding a zipper into said fin, said zipper including a first profile and a second profile, each of said profiles having an interlocking member engageable with an interlocking member of the other profile and an attached flange;

guiding said zipper into position relative to the fin by capturing external surfaces of said first and second profile interlocking members within a first guide member positioned adjacent to said fin;

feeding said flanges along opposite sides of a second guide member positioned within said fin while said interlocking members are captured within said first guide member;

sealing a portion of each of said flanges respectively to an adjacent side of said fin while at least portions of said interlocking members are captured within said first guide member, wherein said first profile attached flange is longer than said second profile attached flange;

peel sealing to the side of the fin adjacent to the second profile, a portion of the first profile flange that extends beyond the second profile flange; and attaching a slider to the zipper.

2. The method in accordance with claim 1 wherein said slider is attached to said zipper after said zipper exits from said first guide.

3. The method in accordance with claim 1 comprising the step of stomping said interlocking members together to form stomped areas at package length intervals along said zipper after said zipper is attached to said fin.

4. The method in accordance with claim 3 wherein said step of attaching a slider to a zipper further comprises the step of attaching a slider to the zipper between each adjacent pair of stomped areas after the formation of said stomped areas.

5. The method in accordance with claim 3 wherein said step of attaching a slider to a zipper further comprises the step of attaching a slider to the zipper between each adjacent pair of stomped areas prior to the formation of said stomped areas.

6. The method in accordance with claim 3 comprising the further step of forming a transverse seal across said tube through each of said stomp areas.

7. A form, fill and seal apparatus for forming reclosable packaging comprising:

a fill tube;

a longitudinally moving web of package making film;

a forming collar upstream of said fill tube for guiding said longitudinally moving web of package making film into a film tube disposed about said fill tube and guiding opposed edges of said film into a fin;

a supply of zipper to be opened and closed by a slider;

means for feeding said zipper from said supply into said fin, said zipper including a first profile and a second profile, each of said profiles having an interlocking member engageable with the other profile and an attached flange;

a first guide adjacent to said fin, said first guide having surfaces thereon extending parallel to said fill tube for capturing external surfaces of said first and second profile interlocking members;

a second guide disposed within said fin between at least a portion of said first guide and said fill tube, said zipper feeding means feeding said profile flanges along opposite sides of said second guide;

a pair of first sealing bars on opposite sides of said second guide, each of said first sealing bars being co-extensive in length with at least a portion of said first guide and each of said pair of first sealing bars closing against respective ones of said opposite sides of said second guide for sealing at least a portion of each of said profile flanges, respectively, to adjacent sides of said fin while at least portions of said profile interlocking members are captured within said first guide;

a stomper means on opposite sides of said fin, downstream of a downstream end of said pair of first seal bars and in-line with said interlocking members for stomping said interlocking members together to form stomped areas at package length intervals along said zipper interlocking members after said zipper is attached to said fin; and a slider attacher downstream of said stomper means for attaching said slider to the zipper after said interlocking members are stomped together.

8. The form, fill and seal apparatus of claim 7 wherein said first profile's attached flange is longer than said second profile's attached flange and further comprising a second pair of sealing bars disposed between said first pair of sealing bars and said fill tube, for peel sealing at least a portion of the first profile flange that extends beyond the second profile flange to the side of the fin adjacent to the second profile flange.

9. The form, fill and seal apparatus of claim 7 further comprising a slider attacher downstream of a downstream end of said first guide for attaching a slider to the zipper after said profile interlocking members are exit from said first guide.

10. The form, fill and seal apparatus of claim 7 further comprising a third pair of sealing bars on opposite sides of said film tube downstream of downstream end of said fill tube.

11. An apparatus for forming reclosable packages comprising:

means for advancing a film of package making material longitudinally to form a tube while guiding opposite longitudinal edges of said film into a fin;

means for feeding a zipper to be opened and closed by a slider into said fin, said zipper including a first profile and a second profile, each of said profiles having an interlocking member engageable with an interlocking member of the other profile and an attached flange;

means for guiding said zipper into position relative to the fin by capturing external surfaces of said first and second profile interlocking members within a first guide member positioned adjacent to said fin;

means for feeding said flanges along opposite sides of a second guide member positioned within said fin while said interlocking members are captured within said first guide member;

means for sealing a portion of each of said flanges respectively to an adjacent side of said fin while at least portions of said interlocking members are captured within said first guide member;

means for attaching a slider to the zipper; and means for stomping said interlocking members together to form stomped areas at package length intervals along said zipper after said zipper is attached to said fin.

* * * * *